US007311297B1

(12) United States Patent
Bradshaw et al.

(10) Patent No.: US 7,311,297 B1
(45) Date of Patent: Dec. 25, 2007

(54) ELECTRIC POWERED LIFT WITH LOAD CONTROL

(76) Inventors: Franklin C. Bradshaw, 212 W. Lodge Dr., Tempe, AZ (US) 85283; Craig Churchill, 212 W. Lodge Dr., Tempe, AZ (US) 85283

( * ) Notice: Subject to any disclaimer, the term of this patent is extended or adjusted under 35 U.S.C. 154(b) by 0 days.

(21) Appl. No.: 11/702,393

(22) Filed: Feb. 1, 2007

(51) Int. Cl.
*B66D 1/20* (2006.01)

(52) U.S. Cl. ..... 254/272; 254/271; 254/273; 254/325; 254/326; 280/47.29; 414/490

(58) Field of Classification Search ..... 254/268, 254/271–273, 324–326, 337; 280/47.29, 280/47.28, 47.27, 654; 414/490
See application file for complete search history.

(56) References Cited

U.S. PATENT DOCUMENTS 3,583,572 A * 6/1971 Tax ..... 212/326
4,359,207 A * 11/1982 Maryonovich et al. ..... 254/272
4,471,945 A * 9/1984 McGraw ..... 254/326
5,489,032 A * 2/1996 Mayhall et al. ..... 212/285
5,492,306 A * 2/1996 Zaguroli, Jr. ..... 254/268
5,662,311 A * 9/1997 Waedekin et al. ..... 254/273

* cited by examiner

*Primary Examiner*—Emmanuel M Marcelo
(74) *Attorney, Agent, or Firm*—Gregory J. Nelson

(57) ABSTRACT

A lifting device utilizing a utility winch having an electric motor and cable drum. The cable on the cable drum extends around a pulley located on a load cell beam. Excessive loads will deflect the load cell beam causing a contact on a micro switch to be engaged to shut off power to the motor. The cable is attached to a trolley which reciprocates along a mast between upper and lower limits. The trolley includes a brake which has a drum which engages the mast to stop in travel of the trolley in the event of a cable breakage. Cable tension is also sensed and cable slack will actuate a switch to interrupt power to the electric motor. Various load handling attachments are detachably securable to the trolley.

11 Claims, 11 Drawing Sheets

ELECTRIC POWERED LIFT WITH LOAD CONTROL

FIELD OF THE INVENTION

The present invention relates to electric lifts and more particularly to an adjustable load control for lifts utilizing electrical powered winches.

BACKGROUND OF THE INVENTION

The present invention relates to a lift and particularly to portable lifts of the type which have a winch assembly having a drive motor connected to a drum on which a lifting cable is attached so that it may be wound and unwound.

Hoisting equipment incorporating winches utilize various apparatus and control systems to prevent overloading. Generally, these systems are expensive and, in some cases, require complicated electric-hydraulic systems to sense an overloaded condition and to deactivate the system to avoid potential damage to the system and to avoid presenting a safety hazard in the event a cable should break or become disconnected.

Accordingly, the present invention provides an effective load control system for lifts, particularly lifts using as a power source utilizing winches of the type commercially available to lift loads such as palletized materials, materials on large reels or rolls such as paper and plastic and other similar loads. Winches of this type utilize power heads having an electric motor which are operatively connected to a cable reel or drum and have safety overload features which will stall the unit when load capacity is exceeded. However, such units do not allow for adjustment of the load capacity below the maximum load capacity and do not provide protection in the event a cable breaks.

BRIEF SUMMARY OF THE INVENTION

Briefly, the present invention utilizes a lift which incorporates a utility winch with a power head having an electric motor and a cable drum. The lift has a base supported on wheels and casters for steering and mobility. The base carries an upstanding mast which supports a mounting plate. The mounting plate carries the winch assembly having a power head with a reel to which is attached a cable. The power head has suitable gearing and a clutch and brake. The electric motor may be either an AC motor or a DC motor powered by a suitable power source such as a battery. In the event the DC motor is powered batteries, the batteries are carried on the base of the device. An operator handle may be secured in the device to facilitate mobility so that the device can be manually moved by the operator between loading and unloading stations.

The mounting plate supports a pulley mounted in suitable bearings. The cable from the cable reel extends around the pulley and, in one embodiment, extends downwardly along the mast and around another pulley located on a trolley which is reciprocal along the mast on suitable rollers. The end of the cable is tied off at a fixed location such to the mounting plate. Various attachments are securable to the trolley such as forks, platforms or cradles, depending on the nature of the load. A load cell having a cantilevered beam with predetermined bending characteristics is located on the mounting plate and carries a micro switch. An adjustable contact member is located adjacent the micro switch and may be adjusted to establish the desired load setting. When the contact on the micro switch is engaged as a result of a bending moment being imposed on the beam due to the load, power to the electric motor is interrupted, shutting down the electric winch motor. This will occur if an excessive load is applied to the cable or if the trolley or carrier reaches a limit and engages a stop, increasing the tension in the cable thereby deflecting the load cell beam.

In an alternate embodiment, the mast may extend to a height above the mounting plate in which case the cable extends from the cable drum around the pulley and upwardly to an idler pulley and downward around the idler pulley to the trolley. In this embodiment, the micro switch contact is normally closed and when the load cell beams deflects a predetermined amount, the micro switch contact disengages the stop and the micro switch shuts off power to the winch.

The carrier or trolley incorporates a brake which is actuated in the event of cable failure. The brake includes a eccentrically mounted brake drum which is normally biased by a spring to a position out of contact with the mast. The pulley on the trolley is coupled to the brake drum to normally maintain the drum out of contact with the mast. In the event of a cable breakage, the cable tension holding the brake drum out of contact with the mast will be released and a spring bias applied to the drum will bring the drum into engagement with the mast, quickly stopping the trolley or carrier.

While the invention has been described with reference to a portable or mobile unit, the hoist may also be a stationery unit incorporating the mechanical load cell to shut down power upon occurrence of an overload, as well as the braking system which will prevent descent of a load upon cable breakage. An advantage of the present invention is that it provides an economical lift which may be used with utility winches of the type commercially available to provide adjustable load control and safety features.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1:
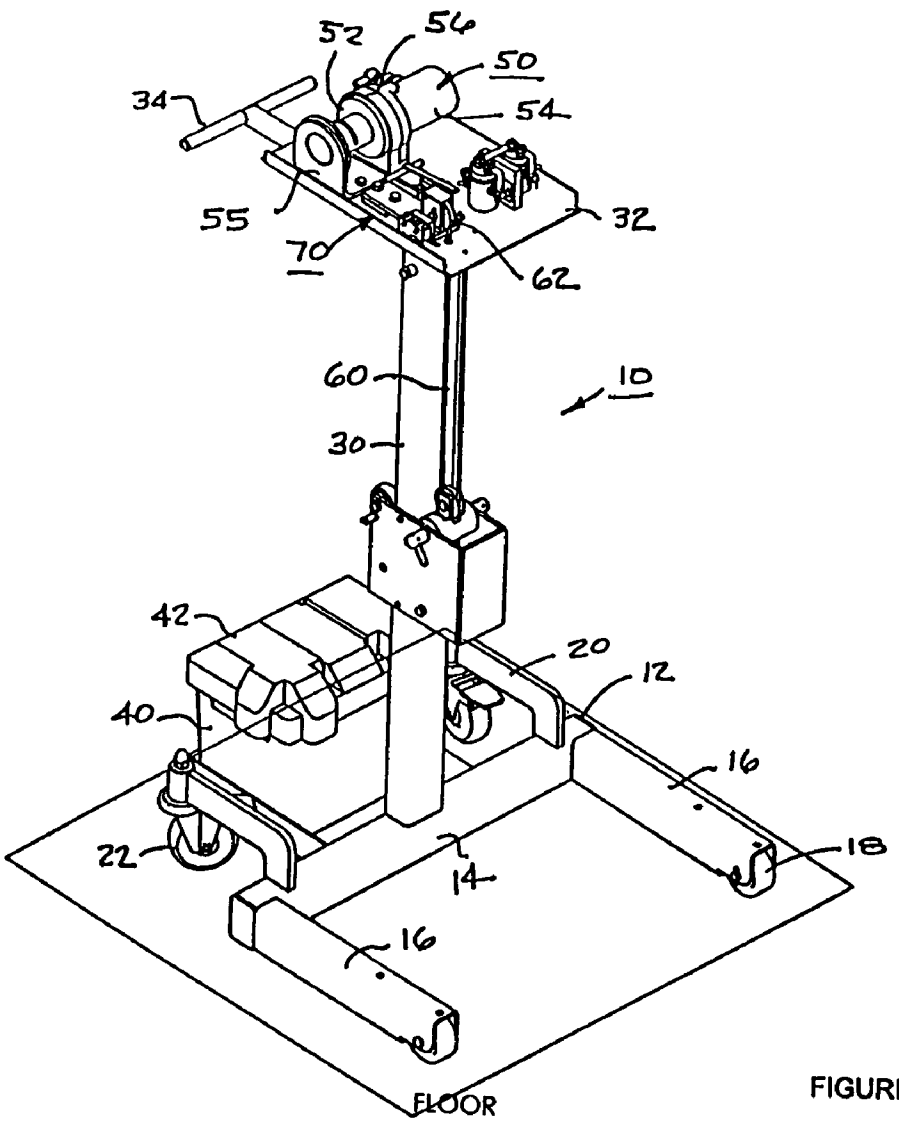
FIG. 1 is a perspective view of one embodiment of the lift assembly of the present invention.
Figure 2:
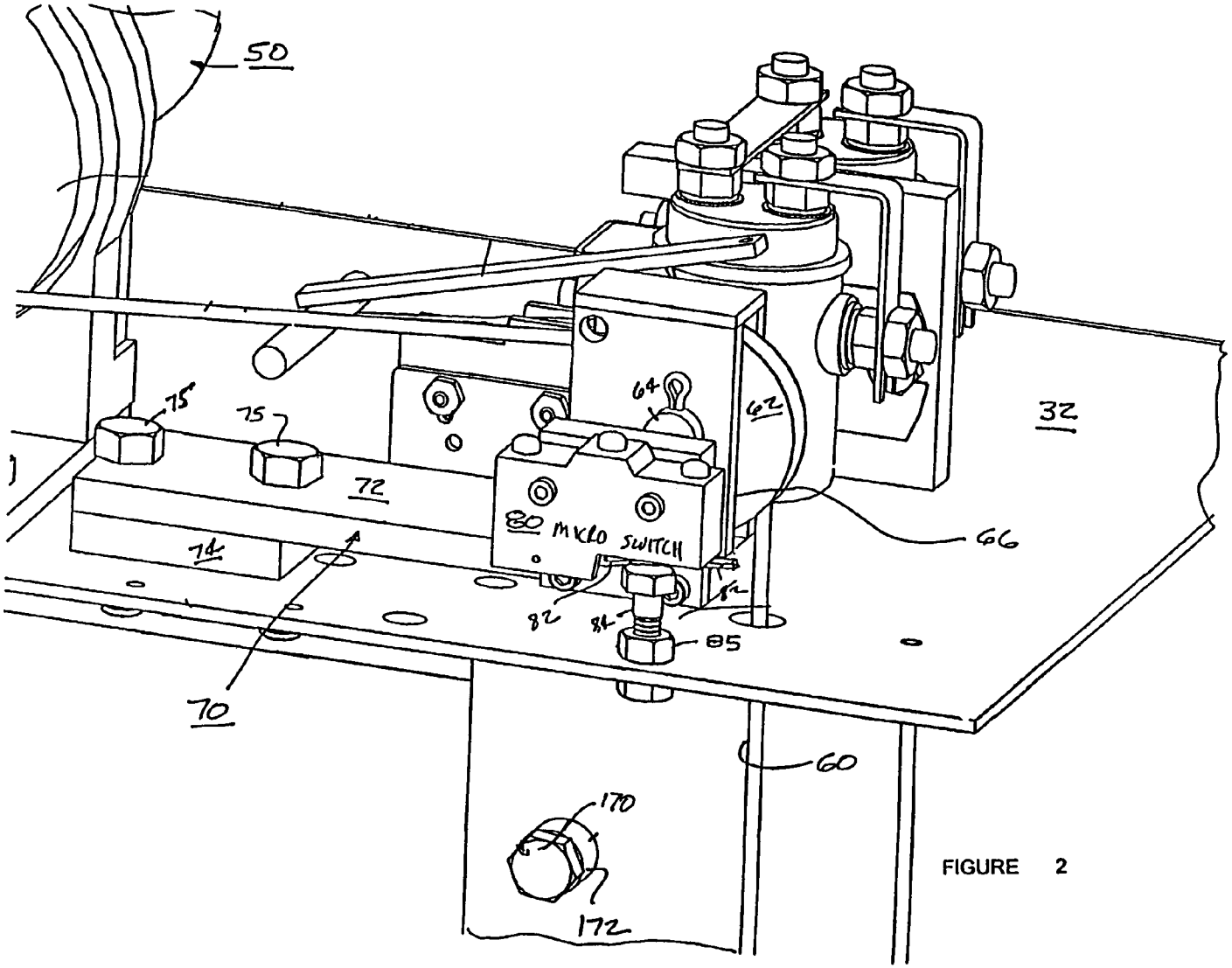
FIG. 2 is a detail perspective view of the winch, pulley and micro switch mounted on a mounting plate at the top of the mast shown with the lift cable extending downwardly.

Turning now to the drawings, particularly FIGS. 1 and 2, a mobile lift 10 according to the present invention is shown. The lift 10 has a base 12 with a main frame member 14 which carries spaced-apart, forwardly extending arms 16. Wheels 18 are provided at the forward end of the arms for mobility. Extending rearwardly from the main frame member 14 are a pair of arms 20, which, at their rearward or distal ends are provided with pivotal casters 22 to provide maneuverability.

A mast 30 extends upwardly from the midpoint of the base frame 14 supporting a mounting plate 32 at its upper end. A handle 34 extends rearwardly from the mast 30 so that the entire lift 10 may be manually guided between loading and unloading stations by an operator.

The lift of the present invention may also be stationery, but a preferred application is a mobile or portable unit. In this case, the base supports a battery case 40 having an openable cover 42. The case and cover are preferably a suitable plastic and the case contains a source of electric power such as rechargeable 12V batteries which will operate the electric powered winch 50.

Winch 50 is shown mounted on plate 32 having a cable reel or drum 52 powered by an electric motor 54 through a suitable gear head 56 which includes a clutch and brake. The winch is secured to the mounting plate 32 by a mounting bracket 55. The present invention may either include winch components manufactured for the lift or may utilize available utility winches. Various utility winch devices of this type are commercially available from manufacturers such as Warn. Most commonly available utility winches may incorporate overload protection features, but do not have provision for adjustability. The present lift utilizes and incorporates load limiting features which will shut off power to the winch at preselected loads.

In FIGS. 1 and 2, a cable 60 is shown extending from the winch 50 outwardly and downwardly over a pulley 62 which is rotatably mounted on shaft 64 in bearing block 66 as part of a load cell 70. The load cell 70, as best seen in FIG. 2, has a forwardly extending, cantilevered beam member 72 which is secured to the baseplate 32 and supported above the upper surface of the baseplate by a spacer 74 and secured by bolts 75. The beam 72 is steel and has selected deflection characteristics. The pulley 62 and bearing block 66 are secured to the upper surface of the beam at or near its forward end. It will be apparent that the load on lifting cable 60 will impose a downward bending movement on load cell beam 72 causing it to bend or deflect.

A micro switch 80 is also mounted on beam 72 adjacent the pulley having a contact 82. An adjustable contact 84, shown as a bolt, is in threaded engagement with a nut 85 secured to the upper surface of the mounting plate 32 and is aligned with the micro switch contact 82. Thus, by adjusting the relative spacing between the contact 84 and contact 82, the setting or the adjustment of the load limit can be selectively established.

Figure 6:
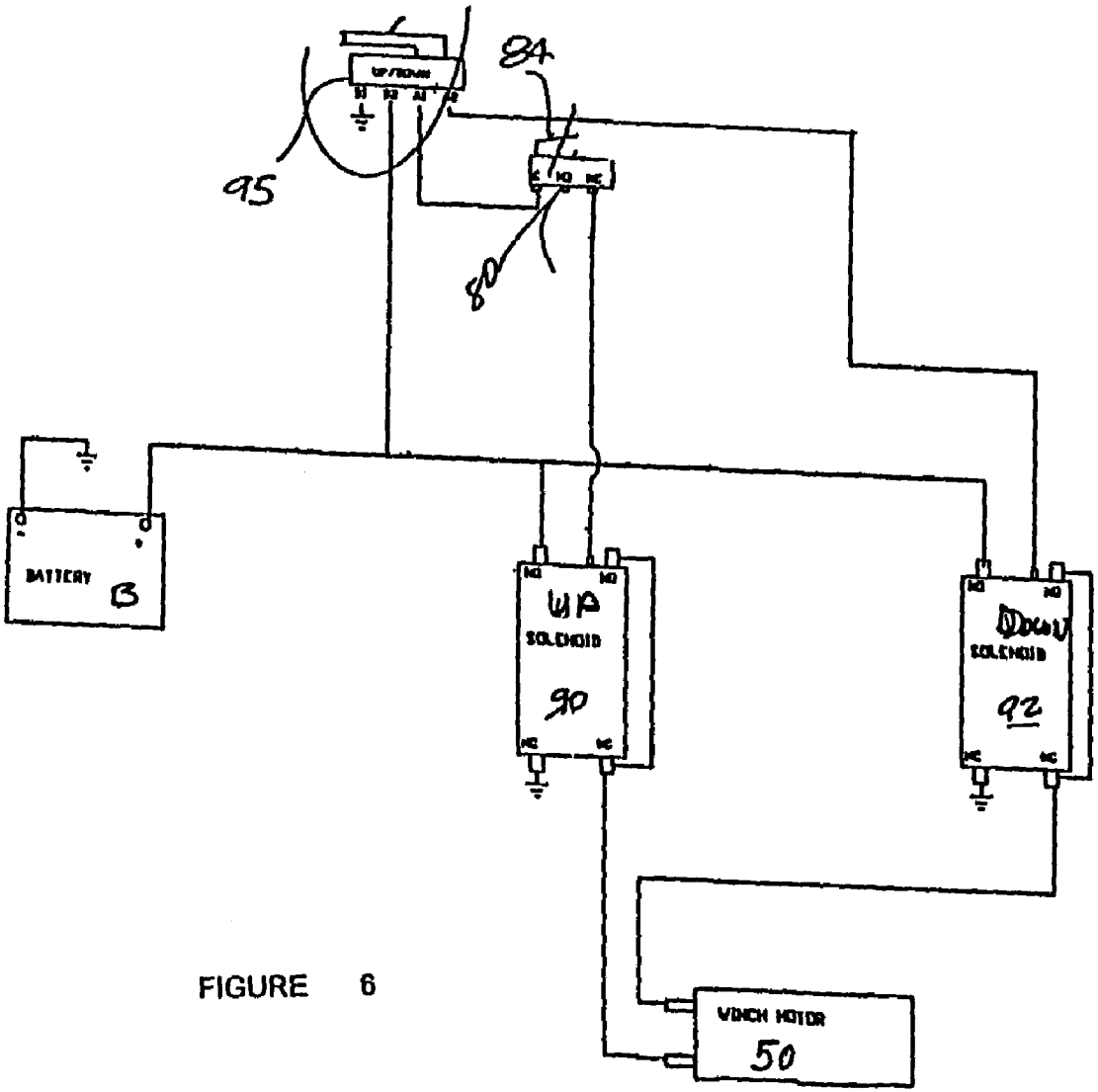
FIG. 6 is an electrical schematic diagram.

Referring to FIG. 6, an electrical schematic is shown in which a battery B is connected to the winch motor 50 across solenoid 90 which is connected to micro switch 80. The motor control 95 can be positioned to either operate the winch motor in a direction to wind or unwind the cable 60 on the drum 52 to cause the load to either lift or descent. The micro switch 80 is located in the circuit to interrupt power to the solenoid 90 which operates the motor in the upward or lift direction. In the event of an overload, as sensed by cable tension, a bending movement is imposed on the load cell beam 72 causing the contact 82 on the normally closed micro switch 80 to engage contact 84 opening the micro switch and shutting off power to the winch motor. The load limit is adjustable at bolt 84 by varying its position relative to the micro switch. Solenoid 92 controls the descent.

Figure 7:
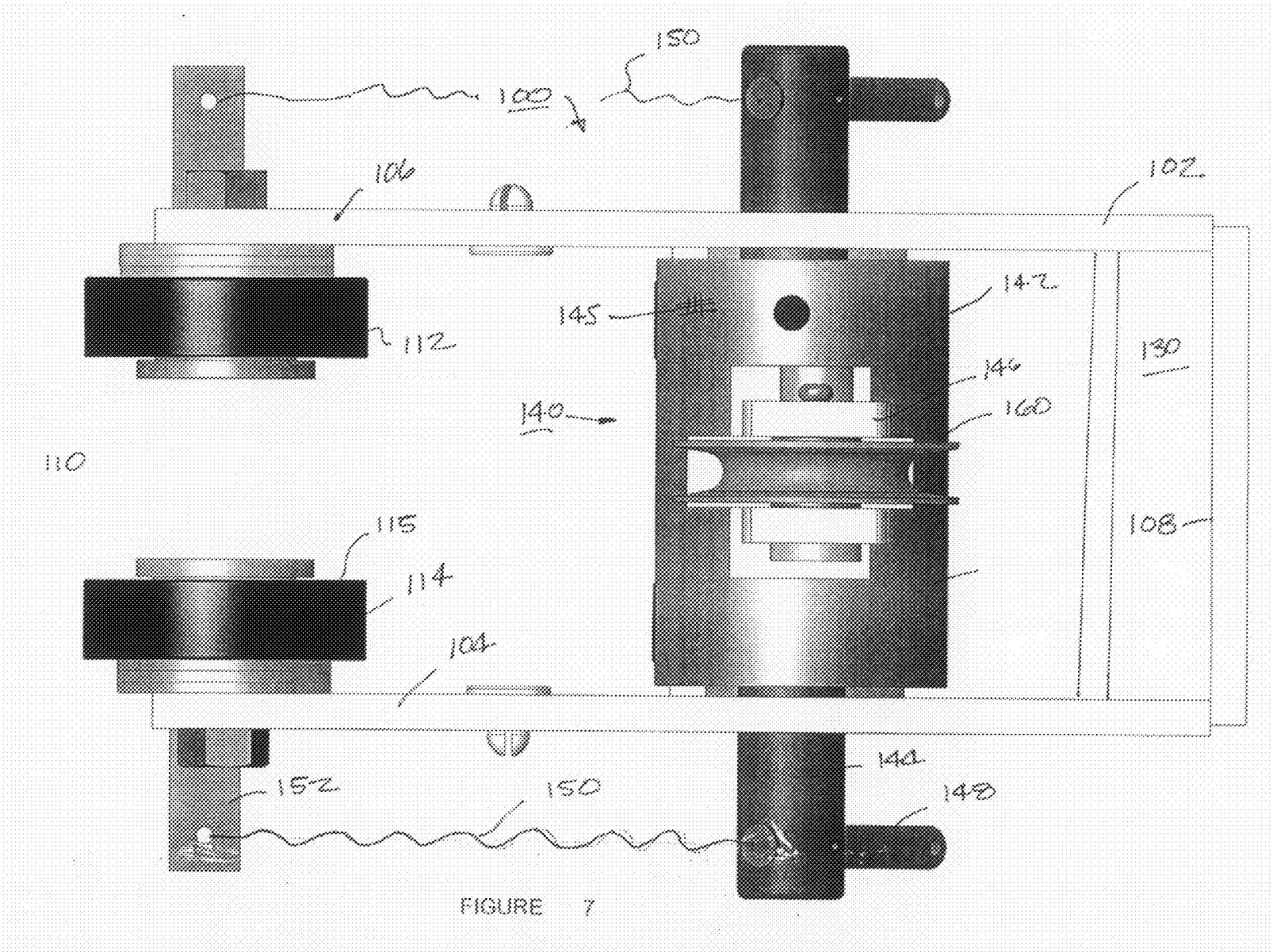
FIG. 7 is a top view of the trolley that reciprocates along the mast having a cable break feature shown in the normal position.
Figure 8:
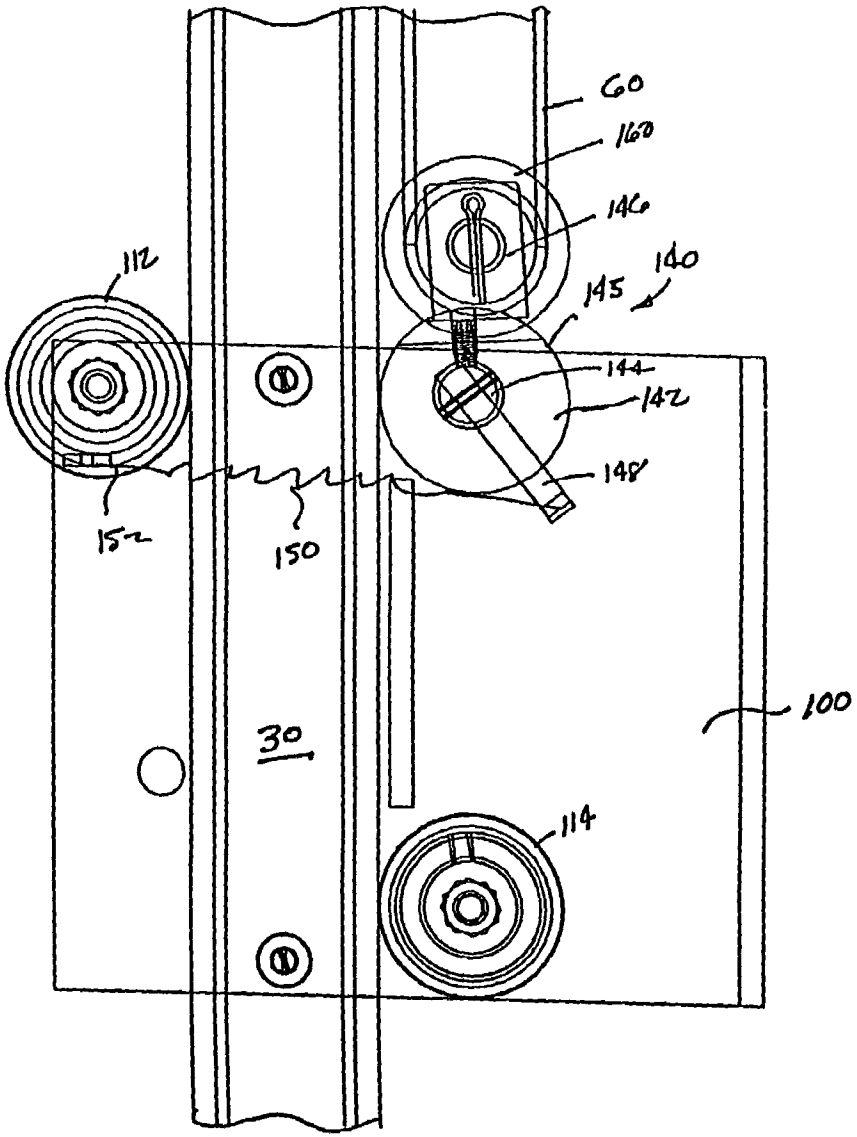
FIG. 8 shows the trolley of FIG. 7 in a normal lift position.
Figure 9:
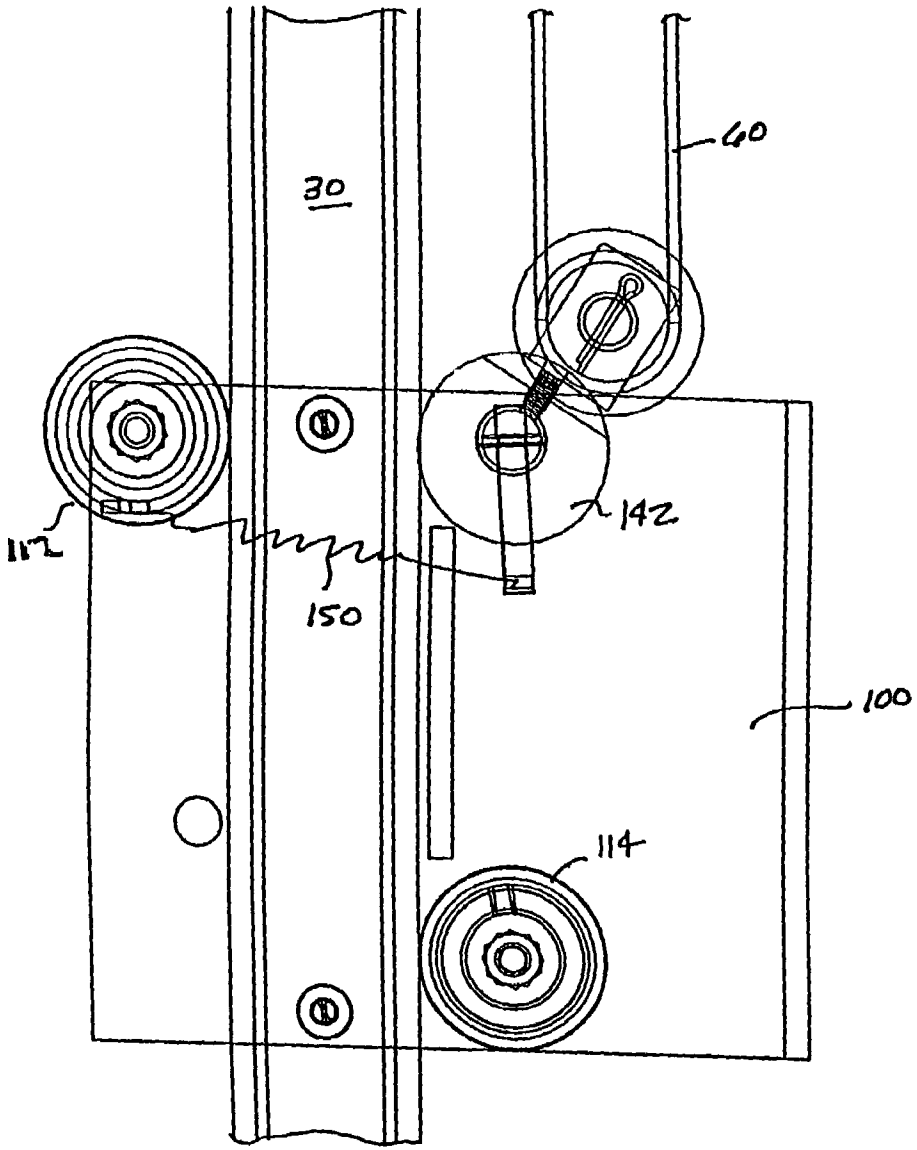
FIG. 9 shows the trolley of FIG. 7 in a braking position which occurs when the lift cable breaks.

The trolley 100 is best seen in FIGS. 7 to 9, and includes a housing 102 having sidewalls 104 and 106 and an end wall 108 defining a generally U-shaped structure. The U-shaped structure having an open end 110. Rollers 112 and 114 are rotatively supported against opposite sides of the mast 30 at spaced-apart locations. The rollers are mounted in suitable bearings and have a resilient surface 115 which engages the surfaces of the mast 30. Therefore, the trolley can reciprocate along the vertical mast.

Figure 11:
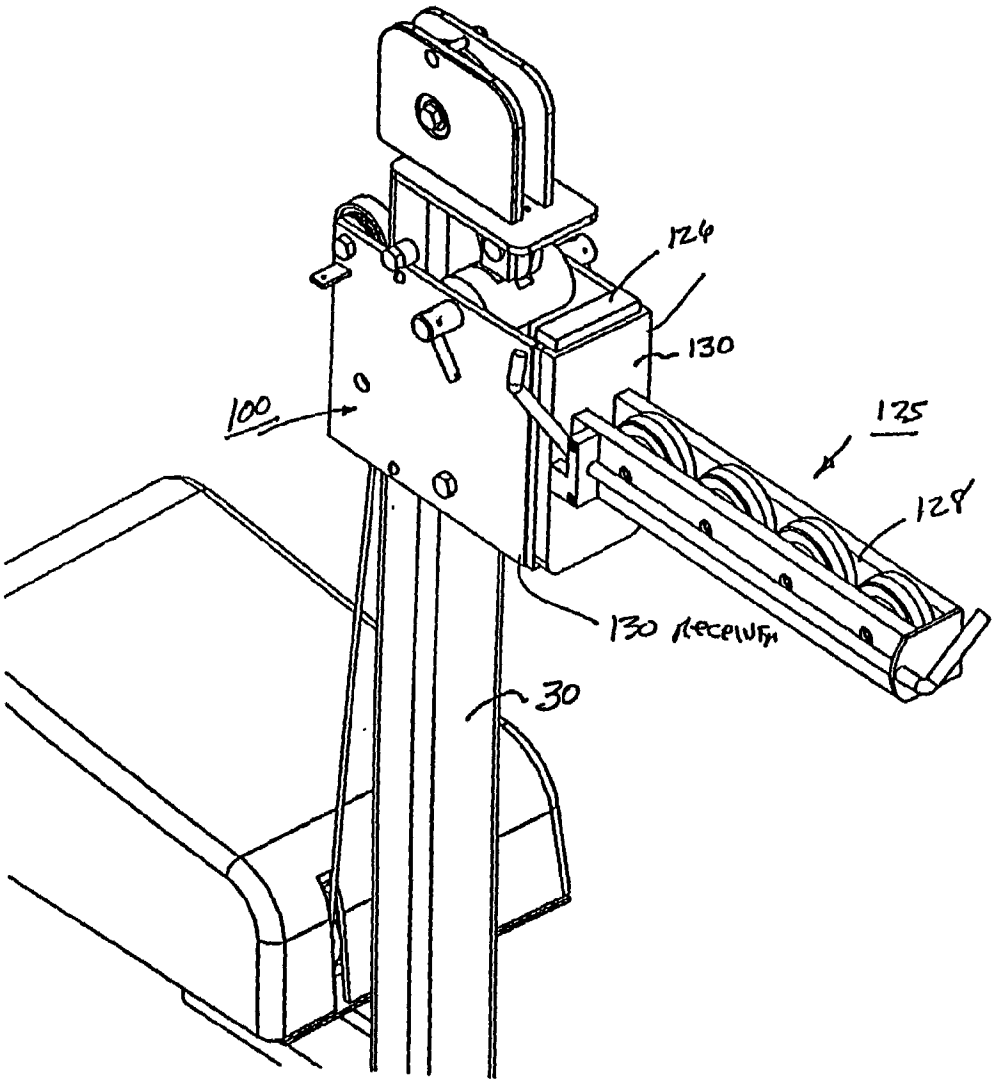

Suitable load carrying attachments, such as a roller core boom 125, as seen in FIG. 11, can be attached to the trolley 100 by inserting the vertical mounting plate 126 at the rear of the attachment into the receiver 130 on the trolley.

Figure 10:
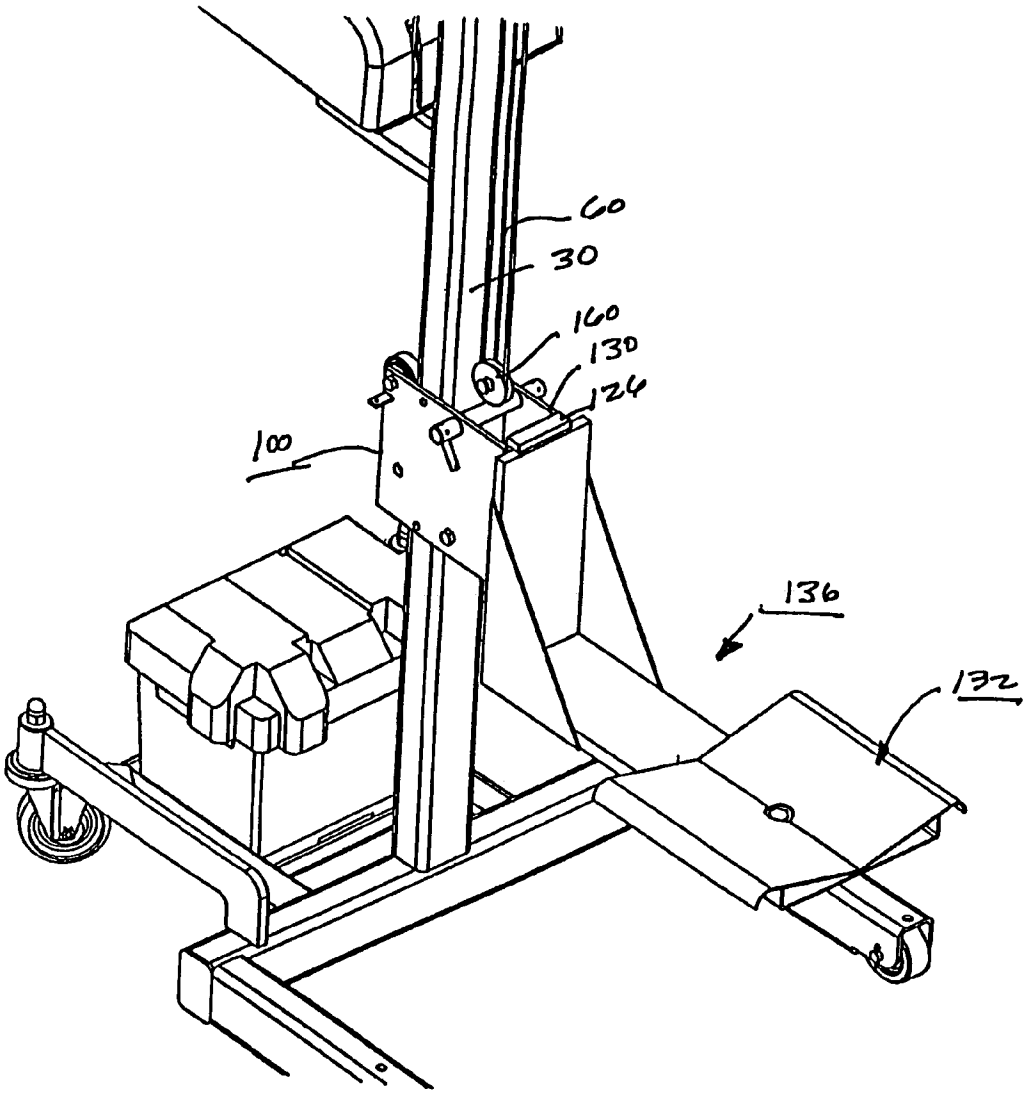
FIGS. 10 and 11 illustrate representative load carrying attachments which are securable to the trolley.

FIG. 10 shows an alternate load carrying attachment 136 having a forwardly extending cradle 132. The rear of the platform has plate 126 detachably engageable in the receiver 130 on the trolley 100. It will be apparent that the design of the load attachment may be varied depending on the particular application and load to be lifted.

The trolley 100 also incorporates a cable brake for safety in the event the cable 60 should break. Referring again to FIGS. 7, 8 and 9, spaced from the rollers 112 is a safety lock 140 which includes a brake drum 142 having a heavily knurled surface 145. The brake drum is rotatably and eccentrically mounted on a shaft 144 extending through the sidewalls of the brake. The upper surface of the brake drum carries a pair of spaced-apart, upstanding mounting plates 146 which rotatively support pulley 160. The outer ends of shaft 144 each carry a projecting arm 148 to which is attached a spring 150. The opposite end of the spring 150 is secured to a support 152.

The cable 60 from the cable reel 52 extends downwardly and extends around the pulley 160 having its free end is secured to the underside of the mounting plate 32. Thus, it will be seen that as the winch is operated in a direction to wind cable on the drum 52, the trolley 100 will be caused to move upward along the mast. Operation of the drum in the opposite direction will pay out cable, allowing the trolley to descend. The tension of the cable 60 on the pulley 132 will normally hold the brake drum 142 in a position out of contact with the adjacent edge of the mast 30. This is shown in FIG. 8. In the event of a cable breakage or excessive slack in the cable, as seen in FIG. 9, the tension imposed upon the brake drum 142 by the cable will be released and the biasing force imposed by spring 150 will allow the eccentric brake drum 142 to rotate into a position with the knurled surface engaging the surface of the mast 30 stopping the trolley 100 and the load from further descending.

The upper travel limit of trolley 100 is established by a stop 170 which is shown in FIG. 2 as a bolt which is secured to the side of the mast carrying a resilient washer 172. The bolt and stop are positioned so that at the upper limit of travel, the trolley will engage the stop and further winding of the cable will increase the tension in the cable causing the micro switch 80 to engage the contact 84 as a result of the bending movement imposed upon load cell beam 72. Similarly, as described, an excessive load will also deflect the load cell beam downwardly causing the micro switch 80 to interrupt power to the winch motor.

Figure 3:
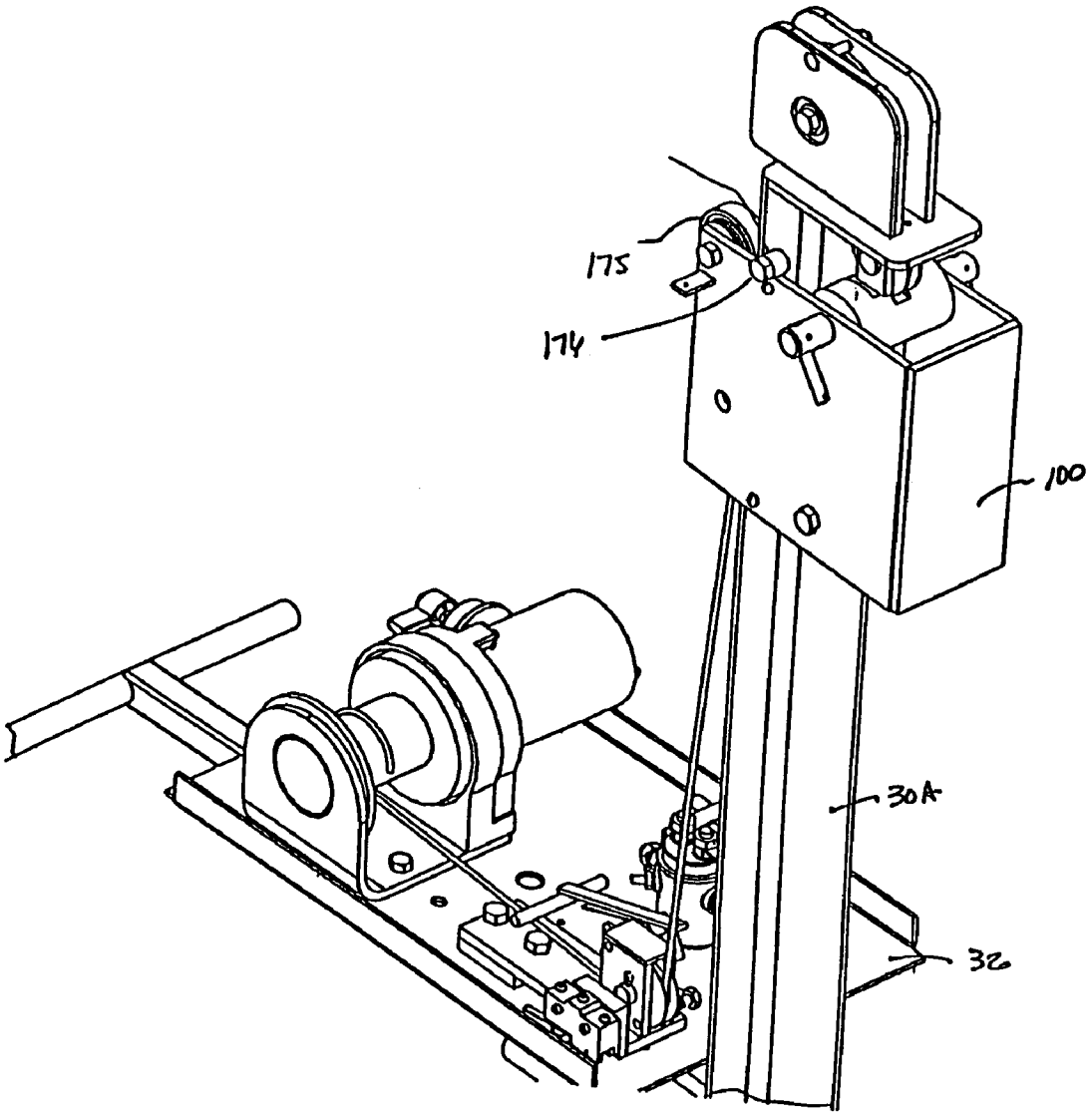
FIG. 3 is a detail perspective view of one side of the mounting plate and components showing the lift cable extending upwardly.
Figure 4:
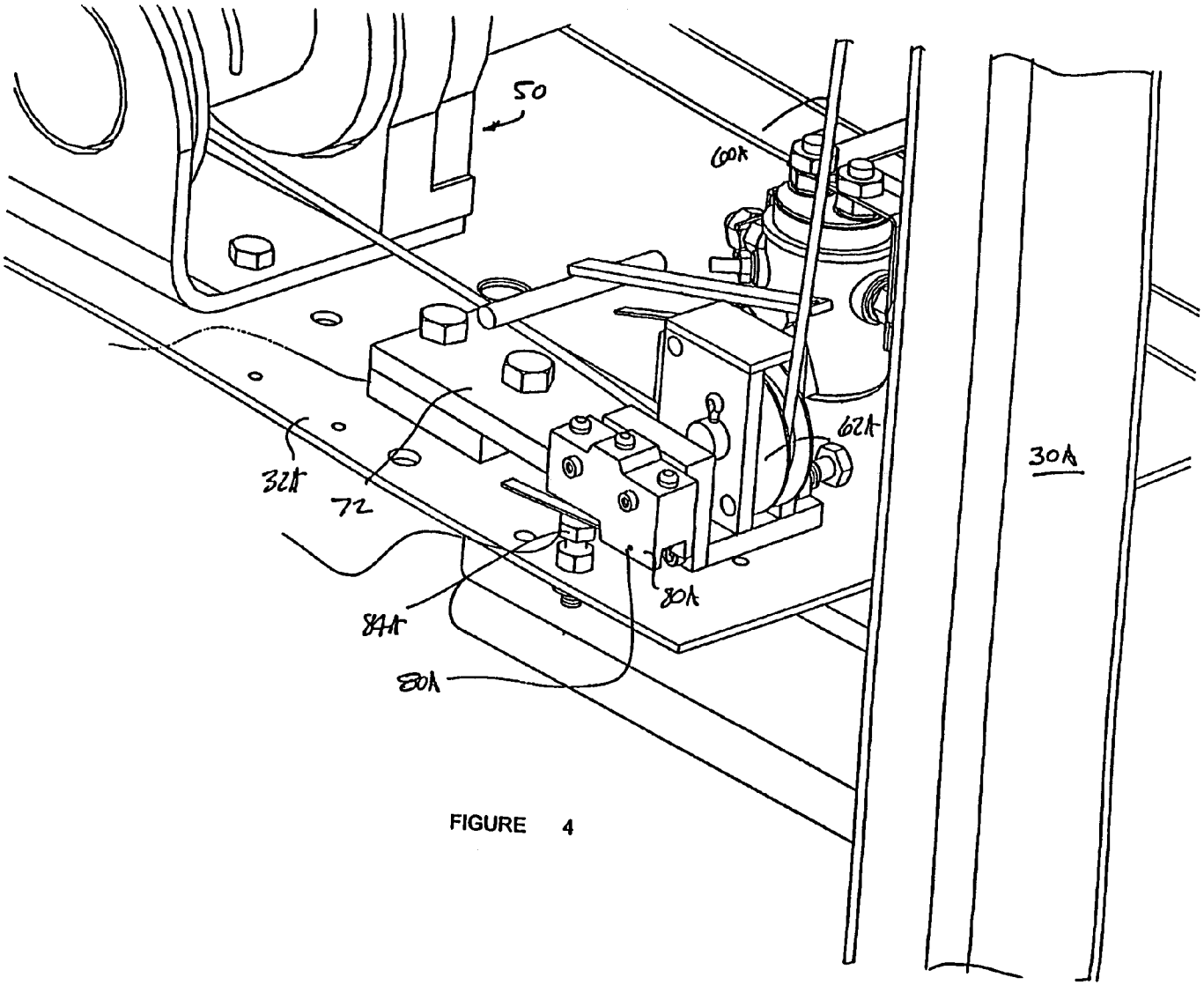
FIG. 4 is an enlarged detail view of the load cell as seen in FIG. 3.
Figure 5:
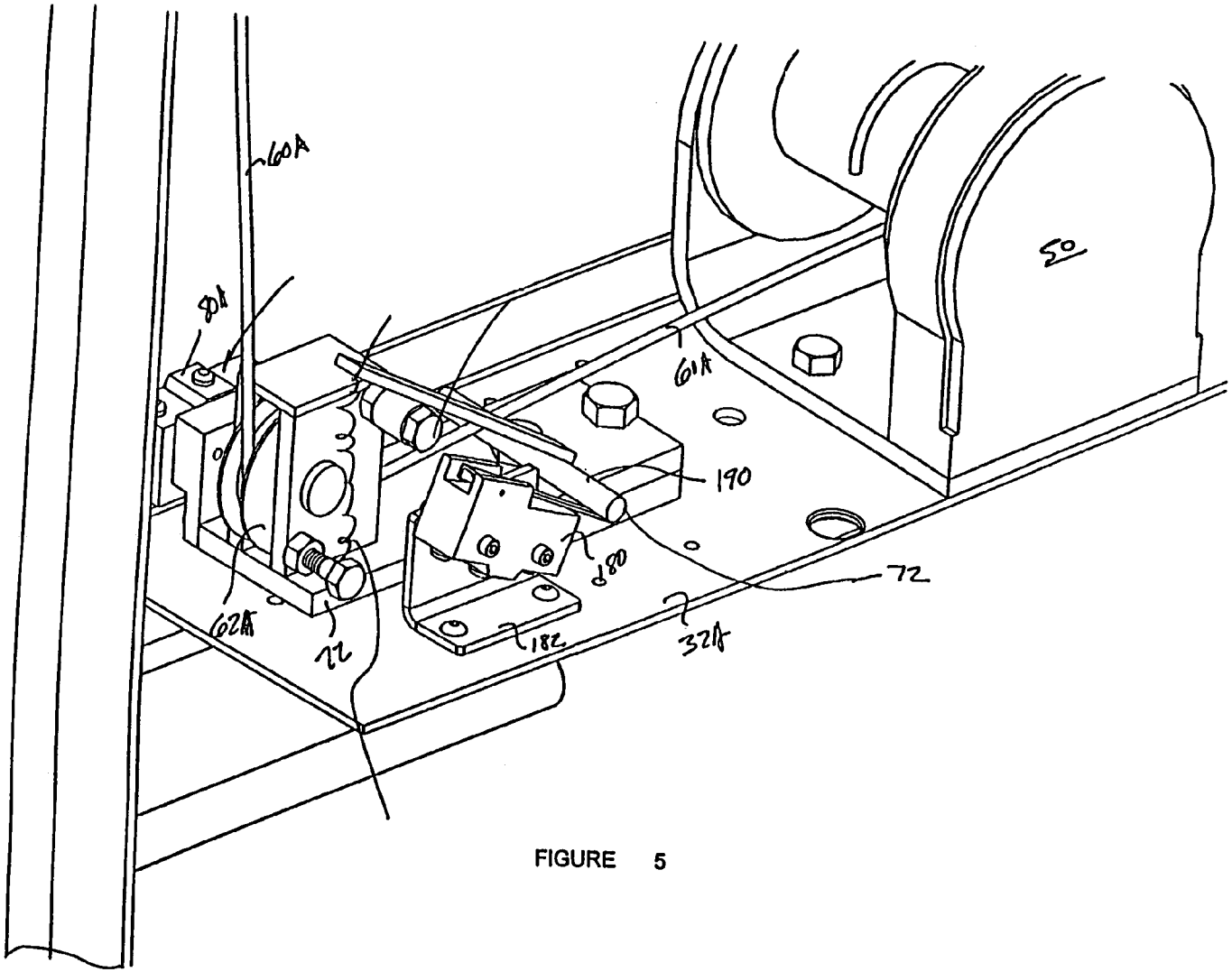
FIG. 5 is an enlarged detail view of the load cell as viewed from the right side of FIG. 4.

In some instances, it is desired to have a mast 30A of extended vertical length. As shown in FIGS. 3, 4 and 5, the mast 30A can project vertically above the mounting plate 32A for extended vertical reach. In this case, the load safety device of the present invention can easily be adapted to accommodate this configuration.

In the configuration shown in FIGS. 3, 4 and 5, the micro switch 80 has been replaced with a normally closed micro switch 80A and the cable 60A from the winch 50 is disposed around the pulley 62A and extends upwardly to idler pulley 175 at the tope of the mast from which the cable extends downward to the pulley associated with the trolley. An upper stop 176 is engaged by trolley 100 at the upper limit of travel. The free or distal end of the cable is then tied off or secured to a fixed location on trolley 100. The cable 60A, due to excessive load lifting, will impose an upwardly, bending movement on the load cell beam 72, causing the micro switch 82A to lift off contact 84A which will shut off power to the winch motor stopping the winch.

Referring to FIG. 5, the embodiment shown in FIG. 4 is also provided with a slack cable shut off. A micro switch 180 is normally open and is mounted on bracket 182 on the side of the load cell beam 72 opposite switch 80A on mounting plate 32A. Cable 60A is shown extending upwardly around pulley 62A. The cable 60A extends across arm 190 which is pivotally mounted to the beam 72 and biased to pivot upwardly. In the event cable 60A becomes slack, the arm 190 will pivot upwardly due to its spring bias causing micro switch 180 to open which will terminate power to the winch motor.

It will be appreciated from the foregoing that the present invention provides an effective and economical lift with a load control feature that can be calibrated or adjusted to accommodate various applications. The lift also incorporates shut-down features in the event of cable slack or breakage.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. A lift comprising:

(a) a base;

(b) a vertical mast extending from the base;

(c) a mounting plate on said mast;

(d) a winch on said mounting plate having an electric motor powering a cable drum having an attached cable;

(e) an electrical circuit connected to operate said electric motor;

(f) a trolley reciprocable along said mast;

(g) a load cell having a deflectable beam (h) a cable pulley on said beam, said cable extending around said pulley and operably connected to said trolley; and (i) a first switch in said electrical circuit and located adjacent the beam so that predetermined deflection of said beam will engage said switch to interrupt the power to said electric motor.

2. The lift of claim 1 wherein said base has wheels and said lift is manually maneuverable.

3. The lift of claim 1 having load carrying means detachably securable to said trolley.

4. The lift of claim 3 wherein said load carrying means comprises a carriage detachably secured to said trolley.

5. The lift of claim 1 wherein said trolley includes a brake drum engageable with said mast, said drum being normally maintained out of engagement by tension in said cable and engageable with said mast to stop the trolley in the event of cable breakage.

6. The lift of claim 5 wherein said brake drum has a knurled surface.

7. The lift of claim 1 including an upper stop limit engageable by said trolley.

8. The lift of claim 1 further including a second switch in said motor circuit operably connected to cable sensing means engaging the cable which will actuate the second switch to interrupt power to the motor in the event the cable becomes slack.

9. The lift of claim 1 wherein the first switch is positioned on said beam adjacent a contact which is engaged upon predetermined deflection of the beam.

10. The lift of claim 9 wherein the relative position of the first switch and contact is adjustable to vary the load capacity.

11. The lift of claim 1 wherein the electrical circuit includes a battery on said base.

* * * * *